US005159903A

United States Patent [19]

Takahashi

[11] Patent Number: 5,159,903

[45] Date of Patent: Nov. 3, 1992

[54] AIR INTAKE SYSTEM FOR TWO CYCLE MULTI CYLINDER ENGINE

[75] Inventor: Masanori Takahashi, Hamamatsu, Japan

[73] Assignee: Sanshin Kogyo Kabushiki Kaisha, Hamamatsu, Japan

[21] Appl. No.: 624,890

[22] Filed: Dec. 4, 1990

[30] Foreign Application Priority Data

Dec. 6, 1989 [JP] Japan ..... 1-317319

[51] Int. Cl.[5] ..... F02B 75/02; F02B 75/18

[52] U.S. Cl. ..... 123/65 A; 123/52 M; 123/73 B

[58] Field of Search ..... 123/65 A, 65 P, 65 PE, 123/73 B, 65 BA, 65 F, 52 M; 440/89

[56] References Cited

U.S. PATENT DOCUMENTS

| | | | |
|---|---|---|---|
| 2,216,491 | 10/1940 | Grantz et al. | 123/65 A |
| 2,228,832 | 1/1941 | Lieberherr | 123/65 A |
| 2,511,992 | 6/1950 | Quick | 123/65 A |
| 4,191,141 | 3/1980 | Franke | 123/65 A |
| 4,622,929 | 11/1986 | Blair | 123/65 A |
| 4,779,581 | 10/1988 | Maier | 123/73 B |
| 4,907,544 | 3/1990 | Barrahm | 123/65 A |
| 4,971,008 | 11/1990 | Moruhita | 123/52 M |
| 5,025,760 | 6/1991 | Webb et al. | 123/65 A |

FOREIGN PATENT DOCUMENTS

| | | | |
|---|---|---|---|
| 56-126619 | 3/1981 | Japan | 123/65 A |

*Primary Examiner*—Raymond A. Nelli
*Attorney, Agent, or Firm*—Ernest A. Beutler

[57] ABSTRACT

Two embodiments of multiple cylinder two cycle internal combustion engines embodying scavenge manifolds that extend around the cylinder bores and which communicate with the cylinder bores through a plurality of circumferentially spaced scavenge ports. The scavenge ports are arranged so that a charge issuing therefrom is not directed toward the exhaust port and the scavenge ports are staggered so as to permit common scavenge manifolds between adjacent cylinder bores to reduce the length of the engine without adversely effecting its breathing ability.

28 Claims, 3 Drawing Sheets

AIR INTAKE SYSTEM FOR TWO CYCLE MULTI CYLINDER ENGINE

BACKGROUND OF THE INVENTION

This invention relates to an air intake system for a two cycle engine and more particularly to an improved scavenging system for a two cycle engine and particularly one having multiple cylinders.

The advantages of two cycle engines due to their simplicity is, of course, well known. However, the porting arrangement of such two cycle engines makes it essential that good exhaust scavenging be accomplished so as to achieve good running of the engine and good fuel efficiency. In connection with achieving good scavenging, it frequently is the practice to have some of the intake charge also pass out of the exhaust port. Obviously, this does not provide optimum performance.

An arrangement has been proposed wherein the intake charge is introduced into the chamber in such a way so as to minimize the amount of intake charge which is discharged through the exhaust port while at the same time insuring that the exhaust charge is fully scavenged. Such a system introduces the charge directly into the cylinder through the cylinder liner without passing through the crankcase. However, the systems of this type previously proposed have employed complicated valve arrangements for controlling the flow which adds to the cost of the engine and further somewhat limits the other practical arrangement for achieving this result and the overall engine construction. Also, the previously proposed does not permit either crankcase precompression or supercharging.

It is, therefore, a principal object of this invention to provide an improved scavenging arrangement for a two cycle internal combustion engine wherein complete scavenging is insured and wherein it will be insured that none of the fresh intake charge passes out of the exhaust port.

It is a further object of this invention to provide an improved induction system for a two cycle engine that will improve scavenging.

In conjunction with the use of scavenging of the type described so as to achieve good scavenging and minimum loss of fresh intake charge, the use of multiple scavenge ports is advantageous. The positioning and servicing of such multiple scavenge ports is difficult with constructions of the type previously employed. Also, the use of multiple scavenging passages has been limited to arrangements embodying crankcase compression.

It is, therefore, a further object of this invention to provide an arrangement for permitting the use of multiple scavenge passages without requiring crankcase compression.

It is a further object of this invention to provide a scavenge manifolding system for a two cycle engine that permits the servicing of multiple scavenge ports.

One way in which multiple scavenge ports can be employed is by providing a scavenging manifold that at least in part extends around the circumference of the cylinder bore. The individual scavenge passages are then served by this scavenge manifold. Although this arrangement has a high degree of utility, its application to multiple cylinder engines can give rise to some problems. Specifically, if this concept is utilized with multiple cylinder engines, then the engine length can be unduly increased. Alternatively, if the scavenge passages for adjacent cylinders have common portions, then there is a danger that the individual scavenge ports may not be served equally by the manifold.

It is, therefore, a still further object of this invention to provide an improved induction system for a two cycle engine having multiple cylinders.

It is a further object of this invention to provide an improved and compact induction system for multiple cylinder two cycle internal combustion engines.

The output of a two cycle engine can be increased by forcing the intake charge into the engine by some form of compressing device such as a supercharger or turbo charger. However, when such forced induction is employed, the scavenging problems become more acute. That is, when a high pressure intake charge is inducted into the combustion chamber, there is a greater risk that a substantial portion of the compressed air charge will pass out of the exhaust ports.

It is, therefore, a further object of this invention to provide an improved induction system and scavenging arrangement for a forced induction two cycle engine.

It is a further object of this invention to provide a forced induction system for a two cycle engine and porting arrangement therefor that will insure that the fresh air charge is not exhausted during the time when the exhaust and intake ports are open while yet insuring good scavenging.

In order to further improve the fuel efficiency of a two cycle engine, the use of fuel injection has been proposed. Although direct cylinder injection is common, the use of direct cylinder injection may not always insure equal distribution of the fuel in the combustion chamber. Also, the fuel discharge from the injector should be in such a way that fuel will not be discharged through the exhaust port during such times as the exhaust port is open. Therefore, there are certain advantages to indirect fuel injection such as the injection of fuel into the induction system rather than into the combustion chamber. However, when this is done, it also should be done in such a way as to insure against the discharge of fuel through the exhaust ports during the scavenging operation.

It is, therefore, a still further object of this invention to provide an improved arrangement for injecting fuel into a two cycle engine that will not cause fuel to be discharged from the exhaust ports during the scavenging operation.

SUMMARY OF THE INVENTION

A first feature of this invention is adapted to be embodied in an induction system for a two cycle internal combustion engine comprising a cylinder block defining a cylinder bore. A scavenge manifold extends substantially around the cylinder bore and at least two scavenge ports extend from circumferentially spaced locations in the scavenge manifold into the cylinder bore and are opened and closed by reciprocation in the cylinder bore for transferring a charge delivered to the scavenge manifold to the cylinder bore.

Another feature of the invention is adapted to be embodied in a multiple cylinder two cycle internal combustion engine comprising a cylinder block defining at least two adjacent cylinder bores. First and second scavenge manifolds each extend substantially circumferentially around respective ones of the cylinder bores and at least one scavenge port extends from a respective scavenge manifold to the respective cylinder bore and is opened and closed by a piston reciprocating therein. The scavenge manifolds have a common portion that extends between the cylinder bores.

A yet further feature of the invention is adapted to be embodied in an induction system for a two cycle internal combustion engine comprising a cylinder block defining a cylinder bore. An exhaust port opens into the cylinder bore at one circumferential location therein. A scavenge port opens into the cylinder bore at a location spaced from the exhaust port and directed so that the flow issuing therefrom is not directed toward the exhaust port when both ports are open. A fuel injector injects fuel into the scavenge port.

DETAILED DESCRIPTION OF THE PREFERRED EMBODIMENTS

Figure 1:
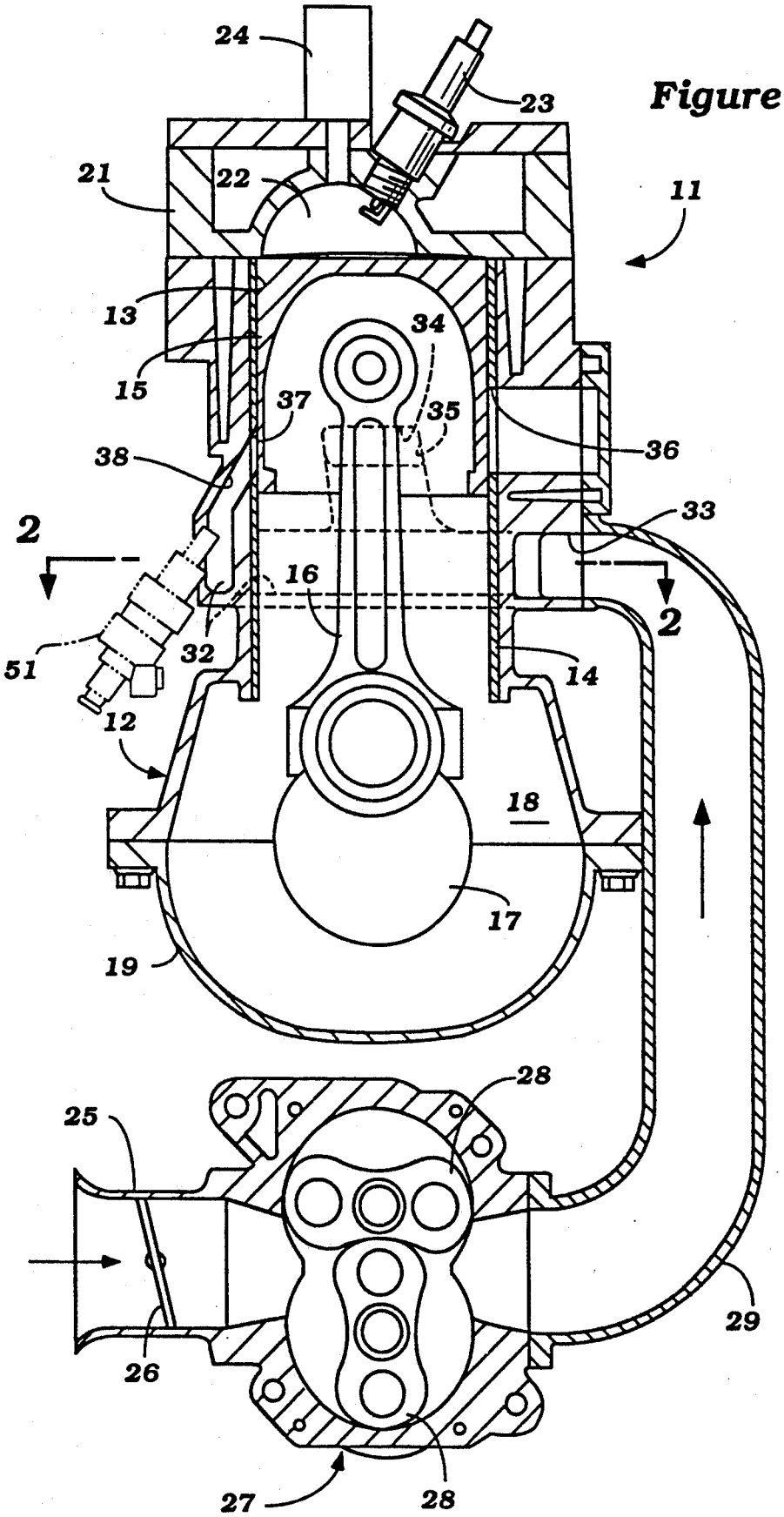
FIG. 1 is a cross sectional view taken through a single cylinder of a multiple cylinder two cycle crankcase compression engine constructed in accordance with a first embodiment of the invention.
Figure 2:
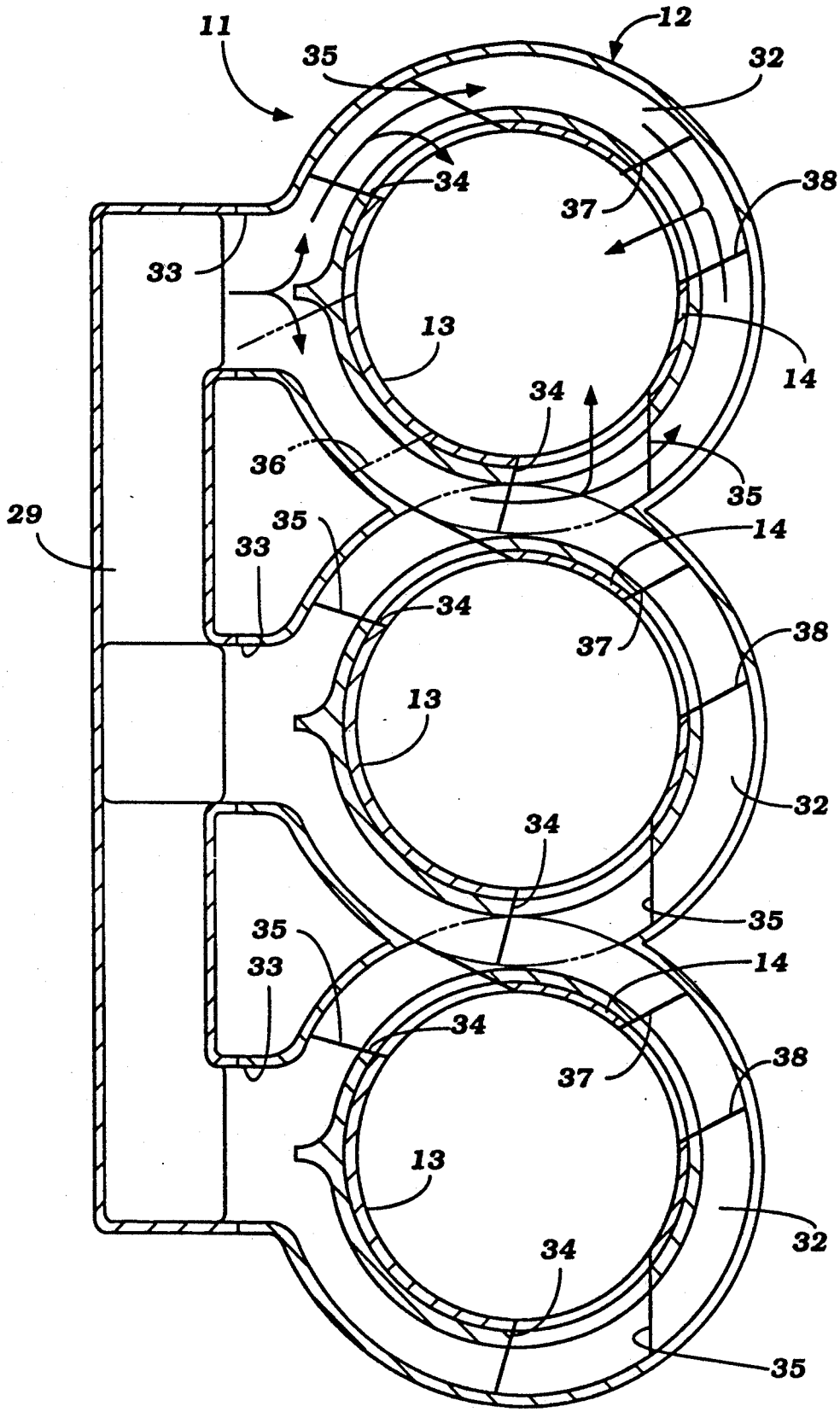
FIG. 2 is a cross sectional view taken along the line 2—2 of FIG. 1.

Referring first to FIGS. 1 and 2, a multi cylinder two cycle crankcase compression engine constructed in accordance with a first embodiment of the invention is identified generally by the reference numeral 11. In the illustrated embodiment, the engine 11 is of the three cylinder in line type. It is to be understood that certain facets of the invention can be utilized in conjunction with single cylinder engines and also that the invention has utility in conjunction with multi cylinder engines of other than in line configuration. However, some features of the invention have particular utility in conjunction with engines having two adjacent cylinder bores, as will become apparent.

The engine 11 is comprised of a cylinder block assembly 12 that is formed with three aligned cylinder bores 13, each formed by a respective liner 14. A piston 15 reciprocates within each cylinder bore 13 and is connected by means of a connecting rod 16 to drive a crankshaft 17 for rotation about a rotational axis. The crankshaft 17 is journaled within a crankcase chamber 18 formed by the cylinder block 12 and a crankcase member 19 which is affixed to the cylinder block 12 in a suitable manner.

A cylinder head 21 is affixed to the cylinder block 12 and has individual recesses 22 which cooperate with the cylinder bores 13 and pistons 15 to form variable volume chambers, sometimes hereinafter referred to as combustion chambers. In the illustrated embodiment, the chamber 22 is offset to one side of the cylinder bore 13 with a squish area being formed around the recess 22. Of course, the invention can be employed in conjunction with engines having other configurations for their combustion chambers.

Spark plugs 23 are mounted in the cylinder head 21 and have their gaps extending into the respective combustion chambers 22 for firing a charge therein. The spark plugs 23 are fired by a suitable ignition system (not shown).

Fuel injectors 24 are also mounted in the cylinder head 21 and inject fuel into each of the combustion chambers 22. A suitable fuel supply system (not shown) is provided for supplying fuel to the injectors 24. If desired, the injectors 24 may be air fuel injectors or these injectors may be pure fuel injectors.

The construction of the engine as thus far described may be considered to be conventional. For that reason, those conventional components of the engine require no further description because it will be apparent to those skilled in the art how the invention can be utilized with a wide variety of otherwise conventional type of engines.

An air induction system is provided for introducing air for combustion and scavenging directly into the cylinder bore 13 without having to flow first through the crankcase chamber 18. This induction system is, in the illustrated embodiment, of the forced type and includes a throttle body 25 in which a flow controlling throttle valve 26 is supported. The air flowing through the throttle body 25 is delivered to a supercharger assembly, indicated generally by the reference numeral 27 and, in the illustrated embodiment, being one of the positive displacement type having a pair of interengaging rotors 28 driven by the crankshaft 17 in a suitable manner. Although the invention is described in conjunction with a supercharged engine and one having a positive displacement supercharger, the invention can be employed in conjunction with centrifugal type superchargers, turbo chargers, other types of devices for increasing atmospheric pressure or, in some instances, purely atmospheric induction systems. The invention, however, has particular utility in conjunction with supercharged or forced induction engines.

A manifold 29 delivers the compressed air from the supercharger 27 to individual scavenge manifolds, each indicated by the reference numeral 32 which are formed integrally within the cylinder block 11. Each scavenge manifold 32 is disposed at a lower portion of the cylinder bore 13 and may be positioned below the bottom dead center position of the piston 15. The scavenge manifolds 32 extend, in this embodiment, completely around the circumference of the cylinder liners 14 and specifically their cylinder bores 13. As will be described, however, such complete circumferential extent need not be necessary in conjunction with the invention.

Each scavenge manifold 32 has a respective inlet port 33 that opens through the side of the cylinder block 12 and which communicates with the manifold 29 for delivery of the compressed air charge to the scavenge manifolds 32. It should be noted from FIG. 2 that the scavenge manifolds 32 have common portions between adjacent cylinder bores 13. This permits the length of the engine to be reduced and because of the porting configuration, to be described, there will be no loss of efficiency or diminution of the equality of flow around the individual cylinder bores 13 because of this commonality of scavenge manifolds 32.

Each cylinder bore 13 is provided with a pair of diametrically spaced apart scavenge ports 34 that open into the cylinder bores 13 at a location that will be uncovered as the pistons 15 approach their bottom dead center position. These scavenge ports 34 are positioned, however, axially above the scavenge manifold 32 as may be clearly seen in FIG. 1. A pair of scavenge passages 35 extend upwardly from the scavenge manifold 32 to the scavenge ports 34. These scavenge passages 35 and the scavenge ports 34 are located so that a charge delivered therefrom will be directly axially away from the manifold inlet 33 and an exhaust port 36 that is disposed above the manifold inlets 33. In this way, the intake charge will be directed away from the exhaust port 36 and this will insure against the loss of any intake charge through the exhaust ports 36. The flow pattern induced in the cylinder bore 13 is such that good scavenging of the exhaust gases will be accomplished.

As may be seen in FIG. 2, the ports as thus far described, are rotated so that the scavenge ports 34 do not extend in a line parallel to the axis of rotation of the crankshaft. As a result of this, the scavenge ports 34 of adjacent cylinder bores 13 will not be aligned with each other, but will communicate with the common portion of the scavenge manifolds 32. This not only permits the cylinder bores 13 to be positioned close to each other and reduce the length of the engine, but also will insure that each scavenge port will receive an equal air flow without starving the others, even though there is this common portion of the scavenge manifold.

A further scavenge port 37 is positioned in communication with the scavenge manifold 32 but diametrically opposed to the exhaust ports 36. The scavenge ports 37 and runners 38 which serve them are directed upwardly toward the cylinder head 21 so that the charge that flows through the scavenge ports will not be directed toward the exhaust ports 36. Again, this insures that the exhaust gases will be well scavenged but that no intake air charge is delivered to the exhaust ports 36 at the time when both the scavenge and exhaust ports are opened.

Figure 3:
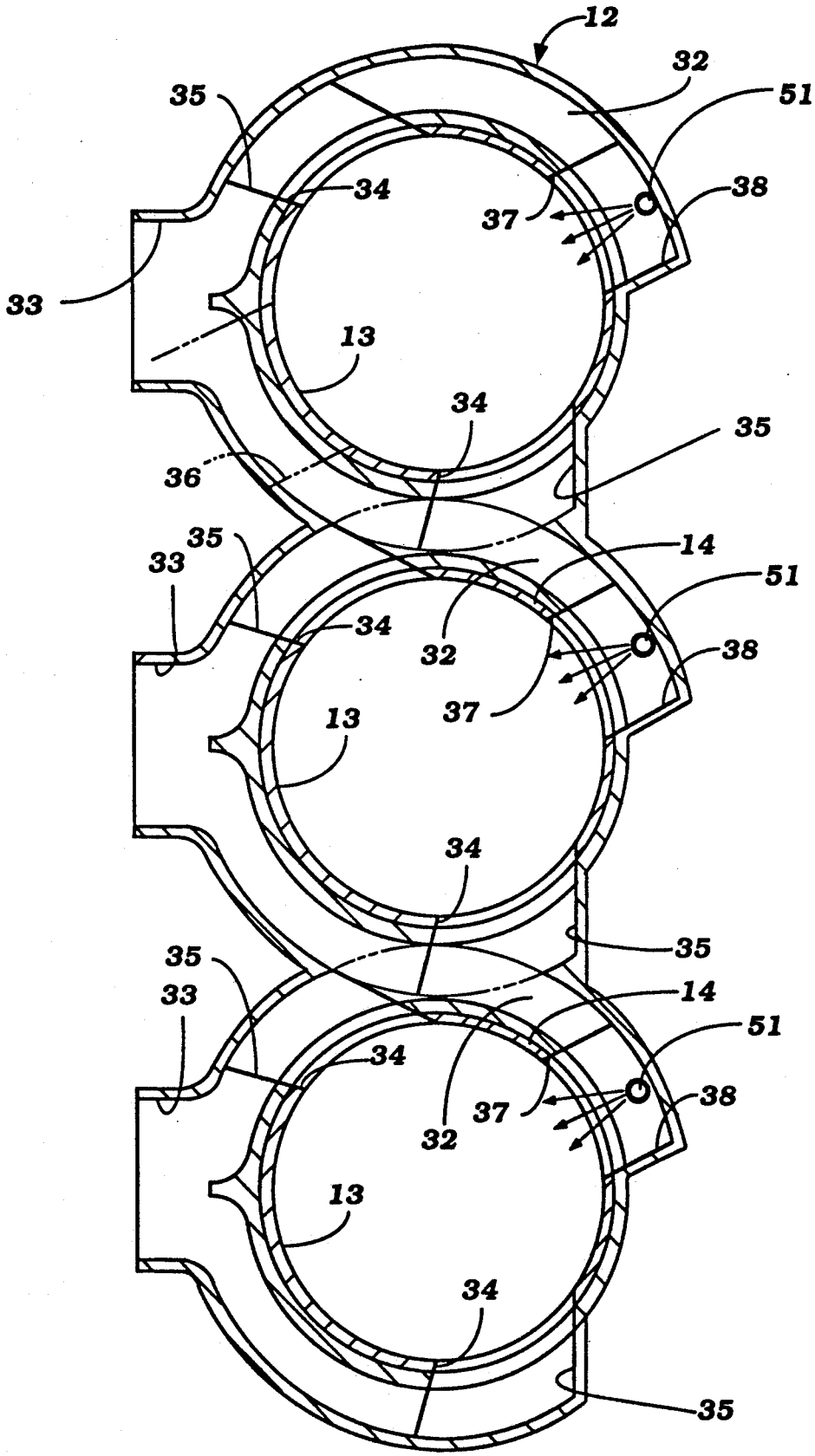
FIG. 3 is a cross sectional view, in part similar to FIG. 1, and shows a second embodiment of the invention.

As has been previously noted, it is not necessary that the scavenge manifolds 32 extend completely around the cylinder bores 13. FIG. 3 shows such an embodiment. Except for this distinction and the location of the fuel injectors, this embodiment is the same as the previously described embodiment. For that reason, the same reference numerals have been employed so as to identify common components. It should be noted, however, in this embodiment, that the scavenge manifold 32 terminates between one of the scavenge passages 35 and the center scavenge passage 38 as clearly shown in this figure. All other portions of the construction are the same and the same advantages as aforenoted are enjoyed by this embodiment.

In this embodiment, a fuel injector 51, which may be of any known type, is positioned in the cylinder block 12 rather than the cylinder head 21 as in the previously described embodiment. This alternate location is shown in phantom in FIG. 1. Each fuel injector 51 is angled upwardly so as to direct its spray along the scavenge passage 38 so as to flow out of the scavenge port 37 in an upward direction toward the combustion chamber 22. This will insure that fuel sprayed directly into the combustion chamber cannot pass out of the exhaust port 36 even if fuel injection is accomplished when the exhaust port 36 is open. Because of the spray of the fuel through the scavenge passage 38, however, better fuel air mixing may be accomplished that with direct cylinder injection.

It should be readily apparent from the foregoing description that the embodiments of the invention are highly effective in insuring good scavenging of a two cycle engine while, at the same time, avoiding the passage of fresh air charge out of the exhaust port. Also, the orientation and configuration is such that a compact multiple cylinder engine can be accomplished and also variations in the location of the injector nozzle are possible without causing loss of fuel from the exhaust port even when injection occurs during the time the exhaust port is open.

The foregoing description is that of the preferred embodiments of the invention. It should be readily apparent to those skilled in the art that various changes and modifications may be made without departing from the spirit and scope of the invention, as defined by the appended claims.

I claim:

1. An induction system for a two cycle internal combustion engine comprising a cylinder block defining a cylinder bore, a scavenge manifold extending substantially around said cylinder bore, at least two scavenge ports extending from said scavenge manifold at circumferentially spaced locations and terminating in said cylinder bore and opened and closed by the reciprocation of a piston in said cylinder bore for transferring a charge delivered to said scavenge manifold to said cylinder bore, and a fuel injector for injecting fuel into said scavenge manifold, said fuel injector being juxtaposed to one of said scavenge ports so that the fuel injected by said fuel injector enters said cylinder bore substantially solely through said one scavenge port.

2. An induction system as set forth in claim 1 wherein an exhaust port extends through the cylinder bore.

3. An induction system as set forth in claim 2 wherein the pair of scavenge ports are configured so that the discharge from them extends from them away from the exhaust port.

4. An induction system as set forth in claim 3 wherein the pair of scavenge ports are diametrically opposed and further including a third scavenge port served by the scavenge manifold, said third scavenge port being configured so that a charge issuing therefrom will be directed away from the exhaust port.

5. An induction system as set forth in claim 4 further including means for delivering a charge to the scavenge manifold at above atmospheric pressure.

6. An induction system as set forth in claim 5 wherein the means for delivering a charge to the scavenge manifold comprises a supercharger.

7. An induction system as set forth in claim 1 wherein the cylinder block defines at least a pair of adjacent cylinder bores, each having a respective scavenge manifold, pair of scavenge ports and a fuel injector.

8. An induction system as set forth in claim 7 wherein the scavenge manifolds for the respective cylinder bores have a common portion extending between the cylinder bores.

9. An induction system as set forth in claim 8 wherein the adjacent scavenge ports of the cylinder bores are staggered relative to each other.

10. An induction system as set forth in claim 8 wherein an exhaust port extends through each cylinder bore.

11. An induction system as set forth in claim 10 wherein the pair of scavenge ports are configured so that the discharge from them extends from them away from the exhaust port.

12. An induction system as set forth in claim 11 wherein the pair of scavenge ports are diametrically opposed and further including a third scavenge port for each cylinder bore served by the respective scavenge manifold, said third scavenge port being configured so that a charge issuing therefrom will be directed away from the exhaust port.

13. An induction system as set forth in claim 12 further including means for delivering a charge to the scavenge manifolds at above atmospheric pressure.

14. An induction system as set forth in claim 13 wherein the means for delivering a charge to the scavenge manifolds comprises a supercharger.

15. An induction system as set forth in claim 2 wherein the scavenge port into which the fuel is injected is directed away from the exhaust port.

16. A multiple cylinder two cycle internal combustion engine comprising a cylinder block defining at least two adjacent cylinder bores, first and second scavenge manifolds each having a respective inlet for receiving an air charge, each of said scavenge manifolds extending substantially circumferentially around substantially only a respective one of said cylinder bores, and at least one scavenge port extending from the respective scavenge manifold into the respective cylinder bore and opened and closed by a piston reciprocating in the cylinder bore, said scavenge manifolds having a common portion extending only between adjacent of said cylinder bores and providing the only communication between said scavenge manifolds.

17. A multiple cylinder two cycle internal combustion engine as set forth in claim 16 wherein the adjacent scavenge ports of the cylinder bores are staggered relative to each other.

18. A multiple cylinder two cycle internal combustion engine as set forth in claim 16 wherein a plurality of scavenge ports extend from each scavenge manifold to the respective cylinder bore.

19. A multiple cylinder two cycle internal combustion engine as set forth in claim 18 further including an exhaust port formed in each cylinder bore.

20. A multiple cylinder two cycle internal combustion engine as set forth in claim 19 wherein the scavenge passages are all directed away from the exhaust port so as to preclude direct communication from the scavenge ports and the exhaust port when all ports are open.

21. A multiple cylinder two cycle internal combustion engine as set forth in claim 20 wherein the pair of scavenge ports are diametrically opposed and further including a third scavenge port positioned between the pair of scavenge ports and served by the scavenge manifold, said third scavenge port being configured so that a charge issuing therefrom will be directed away from the exhaust port.

22. A multiple cylinder two cycle internal combustion engine as set forth in claim 18 wherein the adjacent scavenge ports of the cylinder bores are staggered relative to each other.

23. A multiple cylinder two cycle internal combustion engine as set forth in claim 22 further including a pair of fuel injectors each injecting fuel into a respective scavenge manifold.

24. A multiple cylinder two cycle internal combustion engine as set forth in claim 23 wherein the scavenge port into which the fuel is injected is directed away from the exhaust port.

25. A multiple cylinder two cycle internal combustion engine as set forth in claim 24 wherein the fuel injection is directed upwardly toward a cylinder head associated with the cylinder bore.

26. A multiple cylinder two cycle internal combustion engine as set forth in claim 24 wherein the scavenge port through which the fuel is injected is directed axially away from the exhaust port relative to the cylinder bore axis.

27. A multiple cylinder two cycle internal combustion engine as set forth in claim 16 further including means for delivering a charge to the scavenge manifold at above atmospheric pressure.

28. A multiple cylinder two cycle internal combustion engine as set forth in claim 17 wherein the means for delivering a charge to the scavenge manifold comprises a supercharger.

* * * * *

UNITED STATES PATENT AND TRADEMARK OFFICE

CERTIFICATE OF CORRECTION

PATENT NO. : 5,159,903

DATED : November 3, 1992

INVENTOR(S) : Masanori Takahashi

It is certified that error appears in the above-identified patent and that said Letters Patent is hereby corrected as shown below:

item [56]
On the Title Page under "U.S. Patent Documents" reference 4,971,008, "Moruhita" should be --Morishita--.

Column 8, line 35, Claim 28, "17" should be --27--.

Signed and Sealed this

Ninth Day of November, 1993

Bruce Lehman

*Attest:*

BRUCE LEHMAN

*Attesting Officer*

*Commissioner of Patents and Trademarks*